US007268565B2

(12) United States Patent
Anderson

(10) Patent No.: US 7,268,565 B2
(45) Date of Patent: Sep. 11, 2007

(54) SYSTEM AND METHOD FOR DETECTING RAIL BREAK/VEHICLE

(75) Inventor: Todd Alan Anderson, Niskayuna, NY (US)

(73) Assignee: General Electric Company, Schnectady, NY (US)

( * ) Notice: Subject to any disclaimer, the term of this patent is extended or adjusted under 35 U.S.C. 154(b) by 0 days.

(21) Appl. No.: 11/297,723

(22) Filed: Dec. 8, 2005

(65) Prior Publication Data

US 2007/0132463 A1 Jun. 14, 2007

(51) Int. Cl.
*G01R 27/08* (2006.01)
*B61L 25/00* (2006.01)

(52) U.S. Cl. ..... 324/713; 246/121; 246/122 R

(58) Field of Classification Search ..... 324/713; 246/121, 122, 34 R
See application file for complete search history.

(56) References Cited

U.S. PATENT DOCUMENTS

| | | | | |
|---|---|---|---|---|
| 4,432,517 | A * | 2/1984 | Ripamonti | 246/28 F |
| 4,728,063 | A | 3/1988 | Petit et al. | 246/34 R |
| 5,145,131 | A | 9/1992 | Frank | 246/122 |
| 5,680,054 | A | 10/1997 | Gauthier | 324/713 |
| 5,769,364 | A * | 6/1998 | Cipollone | 246/34 B |
| 6,102,340 | A | 8/2000 | Peek et al. | 246/121 |
| 2003/0038216 | A1 | 2/2003 | Holgate | 246/122 |
| 2006/0060724 | A1 * | 3/2006 | Francis et al. | 246/122 R |

FOREIGN PATENT DOCUMENTS

| | | |
|---|---|---|
| EP | 0038639 A1 | 10/1981 |
| GB | 2208449 A | 3/1989 |
| WO | 97/30878 | 8/1997 |

* cited by examiner

*Primary Examiner*—Walter Benson
*Assistant Examiner*—Timothy J Dole
(74) *Attorney, Agent, or Firm*—Fletcher Yoder

(57) ABSTRACT

A system for detecting a rail break or train occupancy includes a current source adapted to deliver a current to an isolated block of a rail track. A voltage sensor is coupled to the isolated block and configured to detect voltage across the isolated block. A shunt device is coupled to the isolated block and configured to receive a shunt current from the current delivered by the current source. A shunt current sensor is coupled to the shunt device and adapted to detect the shunt current flowing through the shunt device. A control unit is adapted to receive input from the voltage sensor and the shunt current sensor and to monitor a variation of the shunt current with respect to the voltage to detect the rail break or train occupancy.

15 Claims, 10 Drawing Sheets

SYSTEM AND METHOD FOR DETECTING RAIL BREAK/VEHICLE

BACKGROUND

The invention relates generally to a rail break/vehicle detection system and, more specifically, to a long-block rail break/vehicle detection system, and a method for detecting rail break/vehicle using such a system.

A conventional railway system employs a track as a part of a signal transmission path to detect existence of either a train or a rail break in a block section. In such a method, the track is electrically divided into a plurality of sections, each having a predetermined length. Each section forms a part of an electric circuit, and is referred to as a track circuit. A transmitter device and a receiver device are arranged respectively at either end of the track circuit. The transmitter device transmits a signal for detecting a train or rail break continuously or at variable intervals and the receiver device receives the transmitted signal.

If a train or rail break is not present in the section formed by the track circuit, the receiver receives the signal transmitted by the transmitter. If a train or rail break is present, the receiver receives a modified signal transmitted by the transmitter, because of the change in the electrical circuit formed by the track and break, or track and train. In general, train presence modifies the track circuit through the addition of a shunt resistance from rail to rail. Break presence modifies the circuit through the addition of an increased resistance in the rail. Break or train detection is generally accomplished through a comparison of the signal received with a threshold value.

Conventional track circuits are generally applied to blocks of about 2.5 miles in length for detecting a train. In such a block, a train should exhibit a train shunt resistance of 0.06 ohms or less, and the ballast resistance or the resistance between the independent rails will generally be greater than 3 ohms/1000 feet. As the block length becomes longer, the overall resistance of a track circuit decreases due to the parallel addition of ballast resistance between the rails. Through this addition of parallel current paths, additional current flows through the ballast and ties and proportionally less through the receiver. Thus, the signal to noise ratio of the track circuits with train presence becomes low.

In one example, fiber optic-based track circuits may be employed for longer blocks (for example, greater than 3 miles) for detecting trains and rail breaks. However, cost for implementing the fiber optic based track circuit is relatively higher and durability may be lower. In yet another example, ballast resistance is increased and block length of the track circuit may be increased accordingly. However, maintenance cost for maintaining a relatively high ballast resistance is undesirably high.

An improved long block rail break/vehicle detection system and method is desirable.

BRIEF DESCRIPTION

In accordance with one embodiment of the present invention, a method for detecting a rail break or rail vehicle presence includes delivering a current to an isolated block of a rail track. Voltage generated across the isolated block of the rail track is measured. A shunt current flowing through a shunt coupled to the isolated block is measured via a current sensor. The method further includes monitoring a signal proportional to the shunt current with respect to the voltage to detect the rail break or rail vehicle presence.

In accordance with another embodiment of the present invention, a method for detecting a rail break or rail vehicle presence includes delivering a current to an isolated block of a rail track. Voltage generated across the isolated block of the rail track is measured. A shunt current flowing through a shunt coupled to the isolated block is measured via a current sensor. The method further includes comparing a signal proportional to the shunt current and the voltage with respect to a shunt current threshold value and a voltage threshold value to detect the rail break or rail vehicle presence.

In accordance with still another embodiment of the present invention, a system for detecting a rail break or rail vehicle presence includes a current source adapted to deliver a current to an isolated block of a rail track. A voltage sensor is coupled to the isolated block and configured to detect voltage across the isolated block. A shunt device is coupled to the isolated block and configured to receive a shunt current from the current delivered by the current source. A shunt current sensor is coupled to the shunt device and adapted to detect the shunt current flowing through the shunt device. A control unit is adapted to receive input from the voltage sensor and the shunt current sensor and to monitor a variation of the shunt current with respect to the voltage to detect the rail break or rail vehicle presence.

In accordance with yet another embodiment of the present invention, a system for detecting a rail break or rail vehicle presence includes a current source adapted to deliver a current to an isolated block of a rail track. A voltage sensor is coupled to the isolated block and configured to detect voltage across the isolated block. A shunt device is coupled to the isolated block and configured to receive a shunt current from the current delivered by the current source. A shunt current sensor is coupled to the shunt device and adapted to detect the shunt current flowing through the shunt device. A control unit is adapted to receive input from the voltage sensor and the shunt current sensor and to compare the shunt current and the voltage with respect to a shunt current threshold value and a voltage threshold value to detect the rail break or rail vehicle presence.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
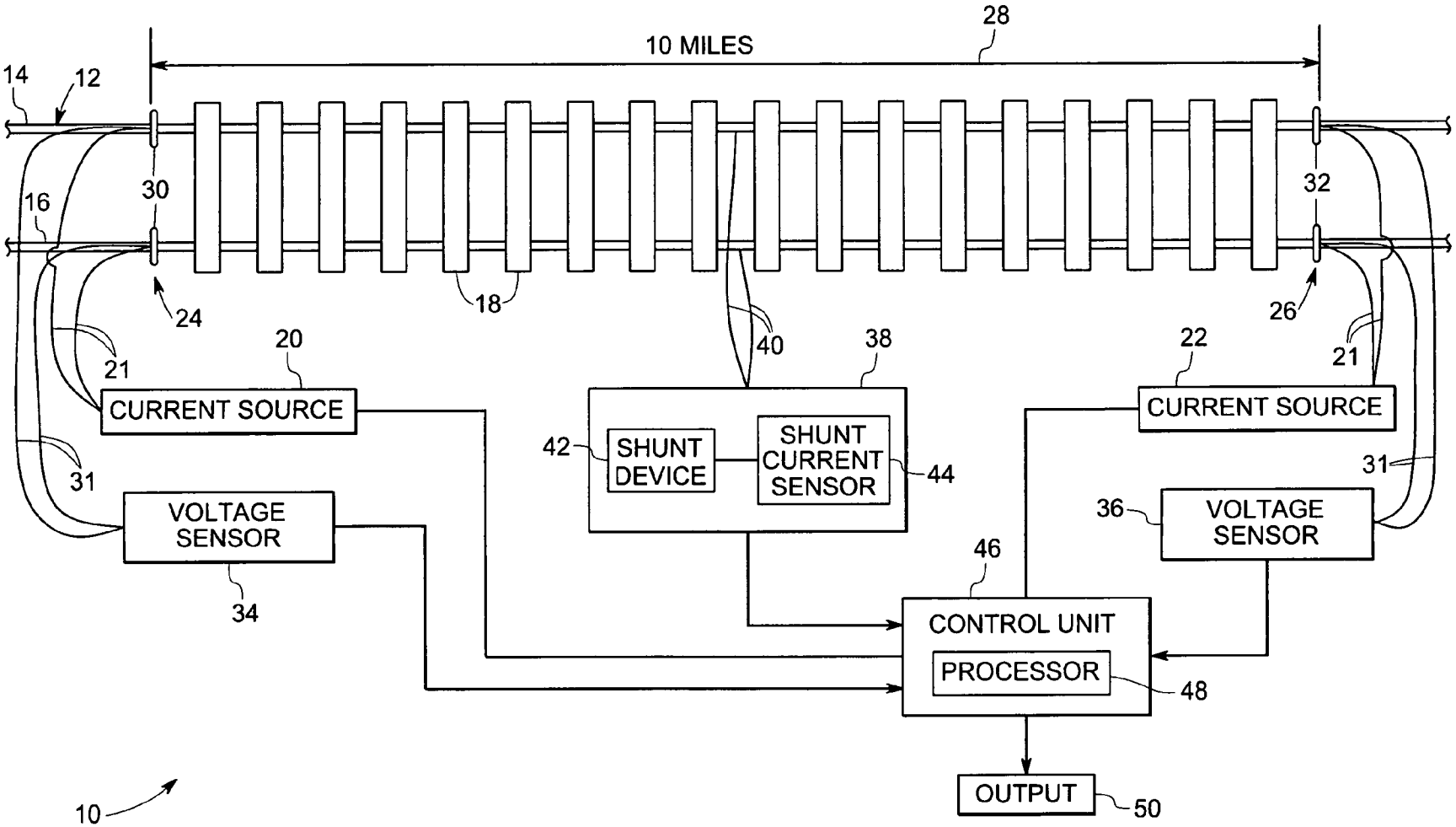
FIG. 1 is a block diagram of a rail break/vehicle detection system in accordance with an exemplary embodiment of the present invention.

Referring generally to FIG. 1, in accordance with several embodiments of the present invention, a rail break/vehicle detection system is illustrated, and represented generally by the reference numeral 10. In the illustrated embodiment, the system 10 includes a railway track 12 having a left rail 14, a right rail 16, and a plurality of ties 18 extending between and generally transverse to the rails 14, 16. The ties 18 are coupled to the rails 14, 16 and provide lateral support to the rails 14, 16 configured to facilitate movement of vehicles, such a trains, trams, testing vehicles, or the like.

Two DC current sources 20 and 22 are communicatively coupled respectively to first and second ends 24 and 26 of an isolated block section 28 formed between two insulated joints 30, 32 of the railway track 12, via a plurality of wires 21. In the illustrated example, the isolated block section 28 of the railway track 12 has a length of about 10 miles. Those of ordinary skill in the art, however, will appreciate that the specific length of the isolated block section 28 is not an essential feature of the present invention. In the illustrated embodiment, the current sources 20, 22 are configured to supply conditioned electric power to the isolated block section 28 of the railway track 12. Two voltage sensors 34, 36 are also coupled respectively to first and second ends 24, 26 of the isolated block section 28 of the railway track 12, via a plurality of wires 31. The sensors 34, 36 are configured to detect the voltage generated across the rails 14, 16.

A receiver unit 38 is coupled to the isolated block section 28 via a plurality of wires 40. In the illustrated example, the receiver unit 38 may be located mid-way through (i.e., about 5 miles from the ends 24, 26 ) the railway track 12. The receiver unit 38 includes a shunt device 42 (for example, a shunt resistor) and a shunt current sensor 44 communicatively coupled across the shunt device 42. The shunt device 42 is configured to receive a shunt current from the current delivered by the current sources 20, 22. The shunt current sensor 44 is configured to detect the shunt current flowing through the shunt device 42. A control unit 46 is communicatively coupled to the receiving unit 38, the current sources 20, 22, and the voltage sensors 34, 36. In one embodiment, the control unit 46 is adapted to receive input from the voltage sensors 34, 36 and the shunt current sensor 44 and monitor variation of the shunt current with respect to the voltage to detect rail break or presence of a rail vehicle on the isolated block section 28 of the railway track 12.

When the block section 28 of the railway track 12 is unoccupied by the rail vehicle or a rail break is not detected, voltage across the block section 28, which is related to the shunt current flowing through the shunt device 42, is constant, provided there are no changes in the environment conditions. When the block section 28 of the railway track 12 is occupied by wheels of a rail vehicle or a rail break is detected, the voltage across the block section 28 varies compared to the condition in which the block section of the track is not occupied by wheels of a rail vehicle or a rail break is not detected. The change in voltage across the block section 28 or the change in shunt current flowing through the shunt device 42 may be monitored to identify the presence of a rail break or a rail vehicle. Neural networks, classification algorithms or the like may be used to differentiate between a rail break or a presence of a rail vehicle on the isolated block section 28 of the railway track 12.

In another embodiment, the control unit 46 is adapted to receive input from the voltage sensors 20, 22, and the shunt current sensor 44 and compare the shunt current and the voltage with respect to a shunt current threshold value and a voltage threshold value to detect rail break or presence of a rail vehicle on the isolated block section 28 of the railway track 12. In one example, if the variation of the shunt current and the voltage with respect to the shunt current threshold value and the voltage threshold value is greater than a predetermined threshold value, presence of a rail break/vehicle is indicated. It should be noted that, as used herein, the term "predetermined threshold value" may assume a plurality of values within predetermined threshold limits. The predetermined threshold value is determined as function of the shunt current threshold value and the voltage threshold value. The rate of change of the shunt current and the voltage with respect to the shunt current threshold value and the voltage threshold value may be used to distinguish train presence and/or rail break from ballast resistance changes or other normal operating condition variations, or to provide information related to train speed, position of the train, or the like. The above-mentioned embodiments are explained in greater detail with respect to subsequent figures.

The control unit 46 includes a processor 48 having hardware, circuitry and/or software that facilitates the processing of signals from the voltage sensors 34, 36 and the shunt current sensor 44. As will be appreciated by those skilled in the art, the processor 48 may comprise a microprocessor, a programmable logic controller, a logic module or the like. The control unit 46 is further adapted to control the current sources 20, 22 to deliver current pulses alternately from the first and second ends 24, 26 of the isolated block section 28 railway track 12. The control unit 46 is also adapted to switch the polarity of the current sources 20, 22 to reverse current flow through the isolated block section 28 of the railway track 12. The measurements of the voltage sensors 34, 36 and the shunt current sensor 44 may be averaged to mitigate systematic and galvanic errors.

In certain embodiments, the control unit 46 may further include a database, and an algorithm implemented as a computer program executed by the control unit computer or the processor 48. The database may be configured to store predefined information about the rail break/vehicle detection system 10 and rail vehicles. The database may also include instruction sets, maps, lookup tables, variables or the like. Such maps, lookup tables, and instruction sets, are operative to correlate characteristics of shunt current and the voltage to detect rail break or presence of a rail vehicle. The database may also be configured to store actual sensed/detected information pertaining to the shunt current, voltage across the isolated block section 28, rail vehicle, and so forth. The algorithm may facilitate the processing of sensed information pertaining to the shunt current, voltage, and rail vehicle. Any of the above mentioned parameters may be selectively and/or dynamically adapted or altered relative to time. In one example, the control unit 46 is configured to update the shunt current threshold value and the voltage threshold value based on a ballast resistance value, since the ballast resistance value varies due to changes in environmental conditions, such as humidity, precipitations, or the like. The processor 48 transmits indication signals to an output unit 50 via a wired connection port or a short range wireless link such as infrared protocol, bluetooth protocol, I.E.E.E 802.11 wireless local area network or the like. In general, the indication signal may provide a simple status output, or may be used to activate or set a flag, such as an alert based on the detected shunt current and voltage. In certain embodiments, a single current source and a receiver unit may be used in accordance with embodiments of the present invention, to detect rail break or presence of rail vehicle on the isolated block section 28 of the railway track 12.

Figure 2:
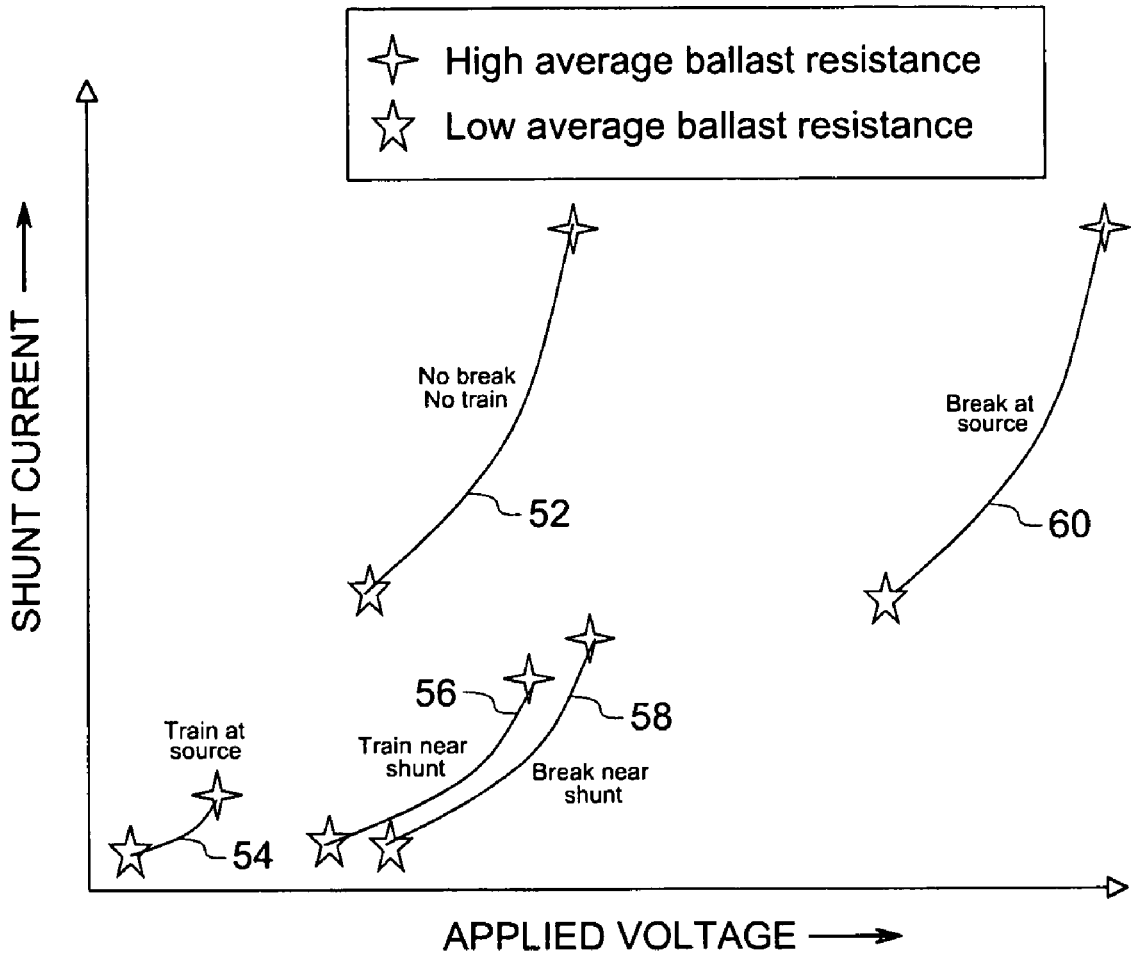
FIG. 2 is a graph representing variation of shunt current with respect to applied voltage, as a function of average ballast resistance for a rail break/vehicle detection system having a shunt device located mid-way through a isolated block section of a railway track in accordance with an exemplary embodiment of the present invention.

Referring to FIG. 2, a graph representing variation of shunt current with respect to applied voltage, as a function of average ballast resistance for a rail break/vehicle detection system having the shunt device 42 located about midway through the isolated block section of the railway track is illustrated. A curve 52 represents "no break/train" condition in the circuit, a curve 54 represents presence of train at the current source, a curve 56 represents presence of train proximate the shunt device, a curve 58 represents presence of rail break proximate the shunt device, and curve 60 represents presence of rail break proximate the current source. When the presence of train shifts from the current source towards the shunt device of the isolated block section, both the shunt current and the corresponding applied voltage are increased. When the presence of rail break shifts from the current source towards the shunt device of the isolated block section, both the shunt current and the corresponding applied voltage are reduced.

Figure 3:
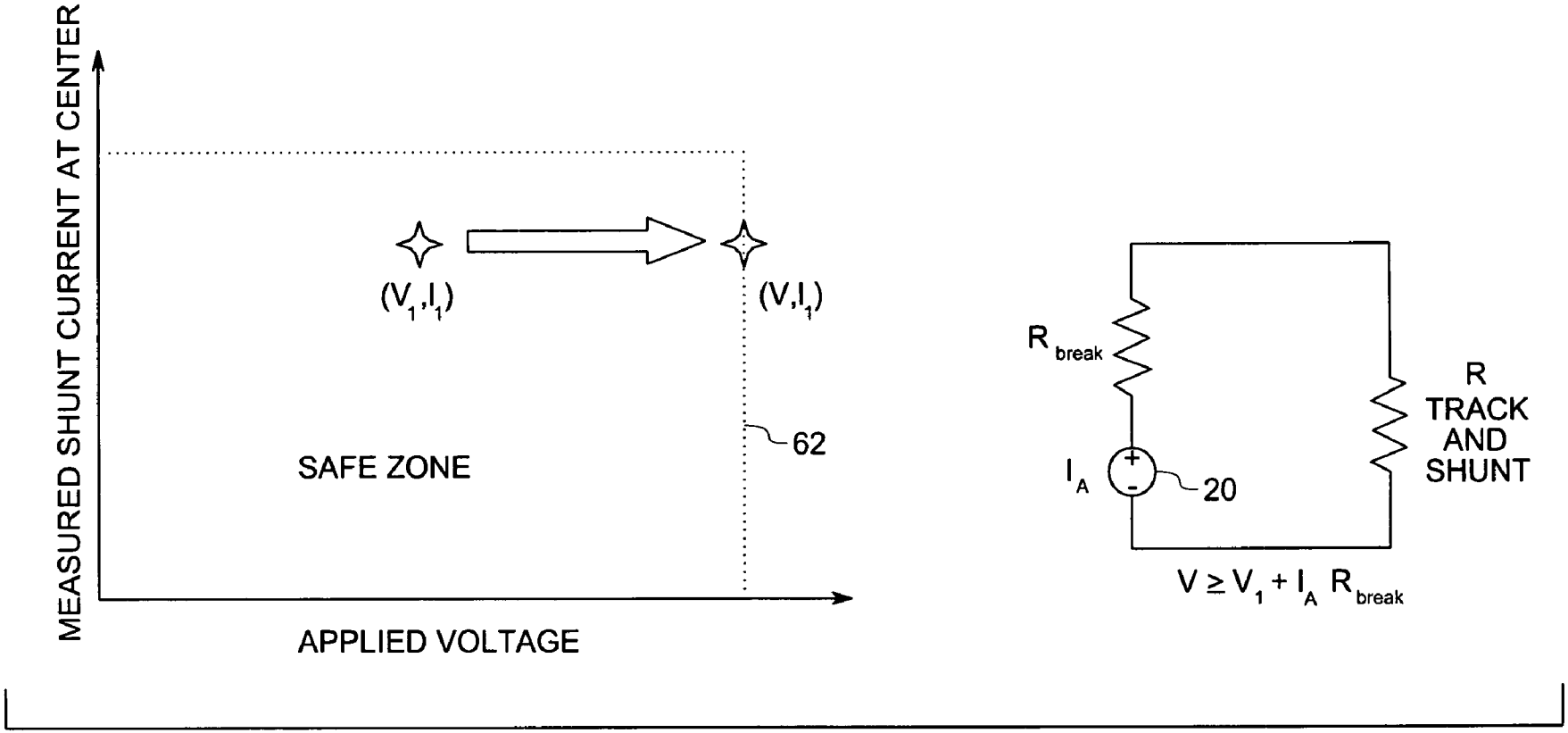
FIG. 3 is a graph representing variation of shunt current with respect to applied voltage having a rail break at a current source along with an equivalent electrical circuit in accordance with an exemplary embodiment of the present invention.

Referring again to FIG. 1, as discussed above, the control unit 46 is adapted to receive input from the voltage sensors 34, 36, and the shunt current sensor 44 and compare the shunt current and the voltage with respect to a shunt current threshold value and a voltage threshold value to detect rail break or presence of a rail vehicle on the isolated block section 28 of the railway track 12. Referring now to FIG. 3, a graph representing variation of shunt current with respect to applied voltage having a rail break at the current source (example, current source 20) is illustrated along with an equivalent electrical circuit. In the illustrated example, the control unit 46 is configured to determine a "safe zone" 62 based on a rail break resistance value. In accordance with the an exemplary embodiment of the present invention, voltage (V) across the isolated block section of the railway track is determined in accordance with the following relation:

$$V \geqq V_1 + I_A R_{break} \tag{1}$$

where $V_1$ is the original no break/no train voltage threshold value, $I_A$ is the current applied by the current source, $R_{break}$ is the resistance due to rail break at the current source. In FIG. 3, R TRACK AND SHUNT is a lumped value of resistance containing all of the resistances in the rail, ballast, and shunt device. It should be noted that, as used herein, the term "voltage threshold value" and "shunt current threshold value" may assume a plurality of values within predetermined threshold limits of voltage and shunt current. In the illustrated example, when presence of rail break is detected at the current source, the shunt current remains constant but the applied voltage is increased.

Figure 4:
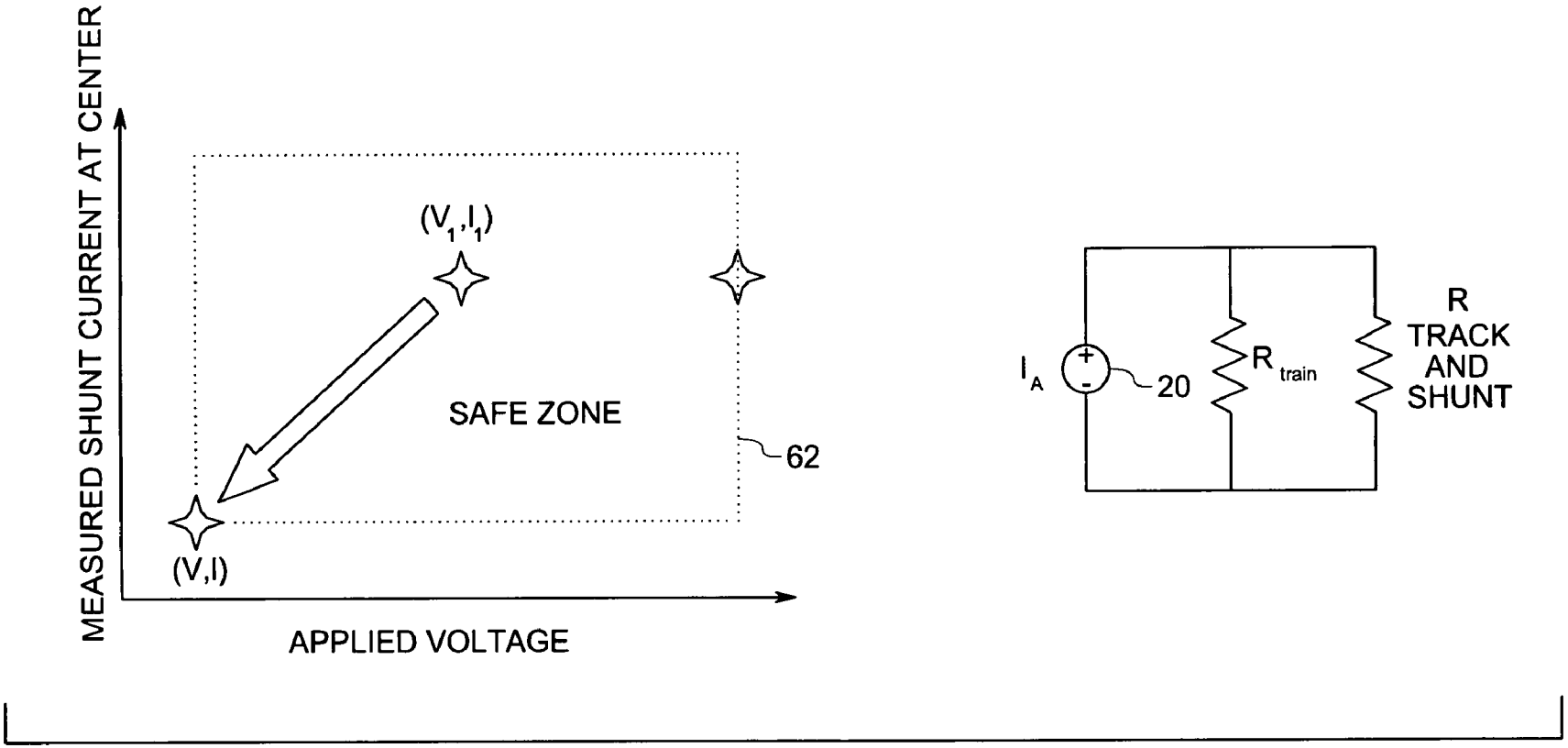
FIG. 4 is a graph representing variation of shunt current with respect to applied voltage having a train presence at a current source along with an equivalent electrical circuit in accordance with an exemplary embodiment of the present invention.

Referring now to FIG. 4, a graph representing variation of shunt current with respect to applied voltage having a train presence at the current source (example, current source 20) is illustrated along with an equivalent electrical circuit. In accordance with an exemplary embodiment of the present invention, voltage (V) across the isolated block section of the railway track is determined in accordance with the following relation:

$$V \leq \frac{I_A V_1 R_{train}}{V_1 + I_A R_{train}} \tag{2}$$

Shunt current (I) is determined is determined in accordance with the relation:

$$I \leq \frac{I_A^2 R_{train}}{I_A R_{train} + V_1} \tag{3}$$

where $V_1$ is the voltage threshold value, $R_{train}$ is the resistance due to presence of train at the current source, and $I_A$ is the current applied by the current source. In the illustrated example, when the train presence is detected at the current source, the shunt current and applied voltage are reduced.

Figure 5:
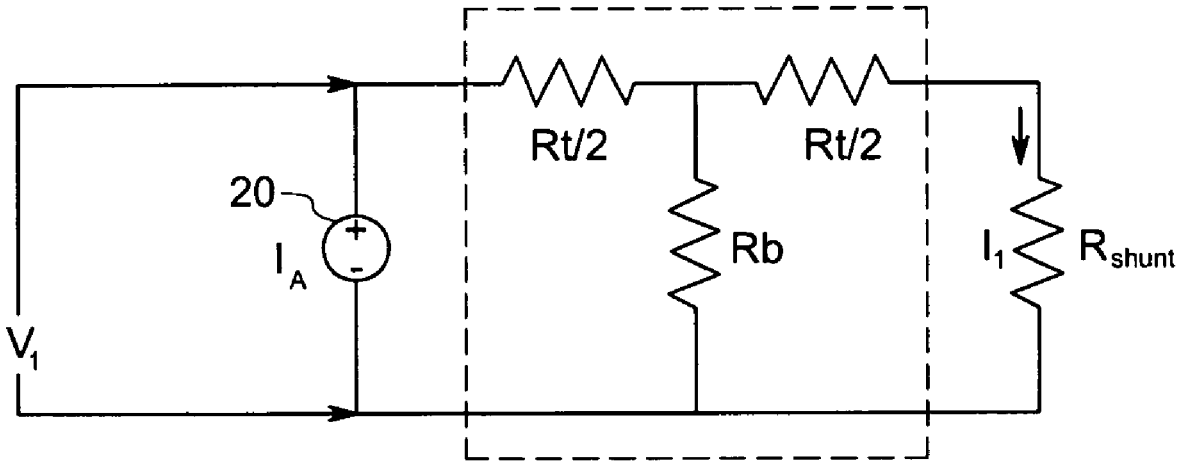
FIG. 5 is a schematic diagram of an equivalent circuit of a rail break/vehicle detection system representing the rail and ballast resistances as two lumped parameters with no presence of rail break/vehicle in the circuit.

Referring now to FIG. 5, a schematic diagram showing an equivalent circuit of the rail break/vehicle detection system representing a means to approximating the rail and ballast resistances in the circuit is illustrated. Ballast resistance ($R_b$) is determined in accordance with the relation:

$$R_b = \frac{I_1(I_A R_{shunt} + V_1)}{I_A^2 - I_1^2} \tag{4}$$

Track rail resistance ($R_t$) is determined in accordance with the relation:

$$R_t = \frac{2V_1 - 2I_1 R_{shunt}}{I_A + I_1} \tag{5}$$

where $V_1$ is the voltage threshold value, $I_1$ is the no break/no train shunt current threshold value, $R_{shunt}$ is the shunt device resistance, and $I_A$ is the current applied by the current source.

Figure 6:
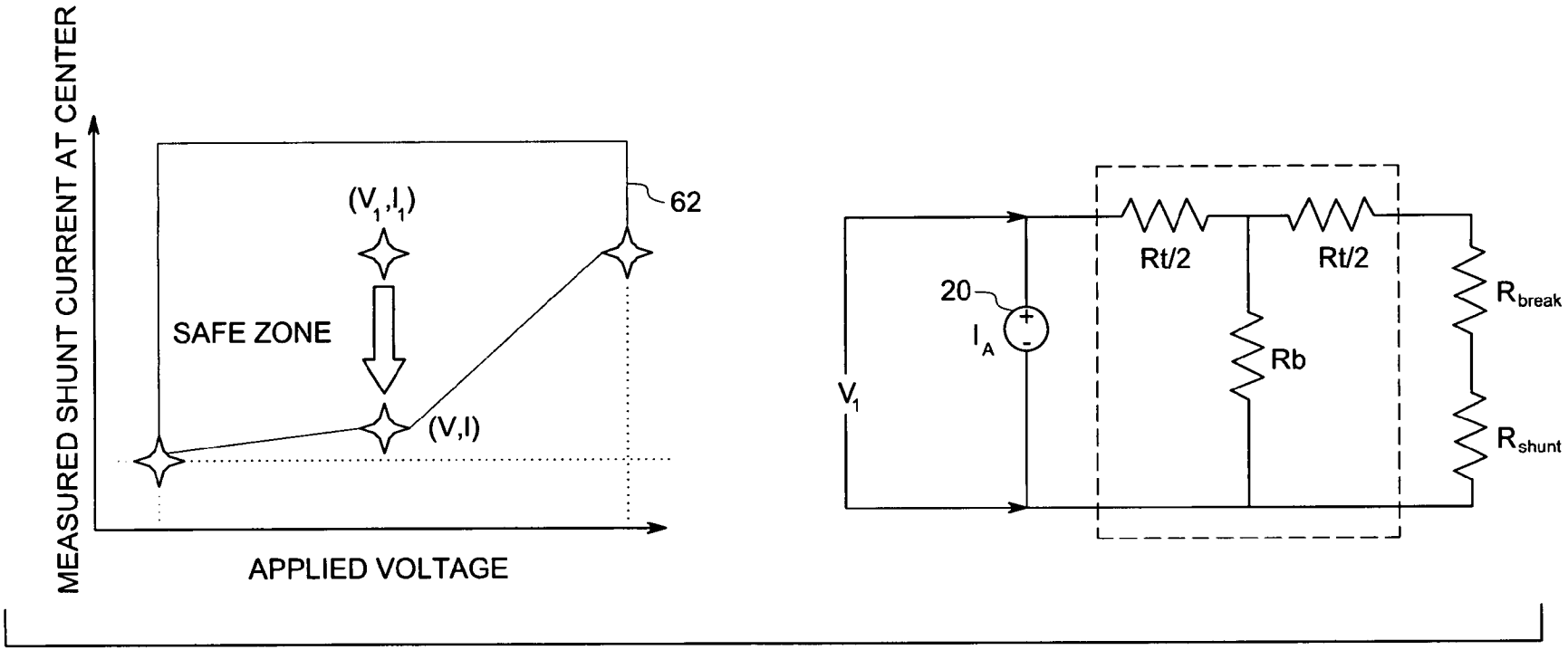
FIG. 6 is a graph representing variation of shunt current with respect to applied voltage having a rail break presence proximate the current shunt device of an isolated block section of a railway track along with an equivalent electrical circuit in accordance with an exemplary embodiment of the present invention.

Referring now to FIG. 6, a graph representing variation of shunt current with respect to applied voltage having a rail break presence proximate the current shunt device of the isolated block section of the railway track is illustrated along with an equivalent electrical circuit. In accordance with the illustrated embodiment, voltage (V) across the isolated block section of the railway track is determined in accordance with the following relation:

$$V \geq \frac{I_A(V_1(I_A(R_{break}+R_s)+V_1)+R_{break}I_1^2R_s)}{I_A(I_A(R_{break}+R_s)+V_1)-I_1^2R_{break}} \quad (6)$$

Shunt current (I) is determined is determined in accordance with the relation:

$$I \leq \frac{I_1 I_A(I_A R_s + V_1)}{I_A(I_A(R_{break}+R_s)+V_1)-I_1^2R_{break}} \quad (7)$$

where $V_1$ is the voltage value, $I_1$ is the no break/no train shunt current threshold value, $R_b$ is the break resistance, $R_s$ is the shunt resistance, and $I_A$ is the current applied by the current source. In the illustrated example, when the rail break presence is detected proximate the shunt device of the isolated block section, the applied voltage remains approximately constant, but the shunt current is reduced.

Figure 7:
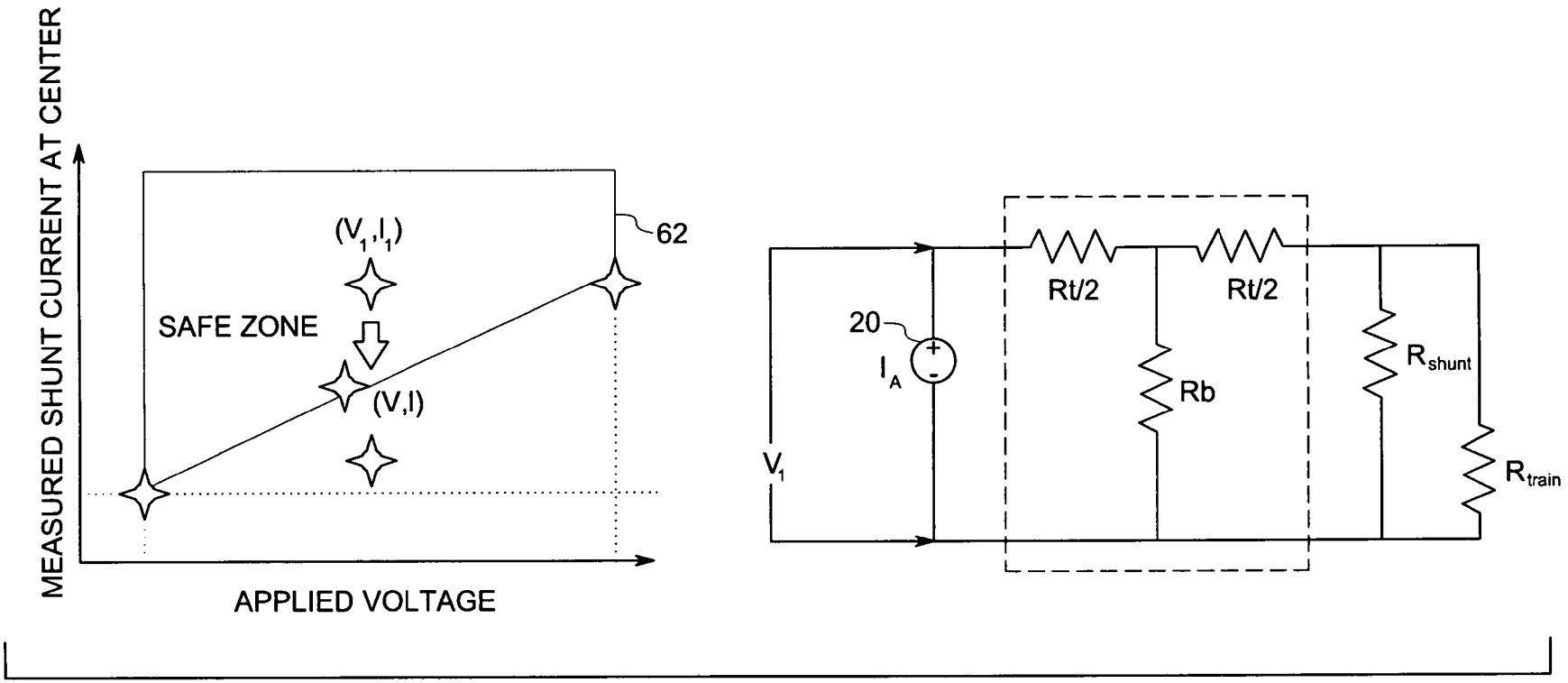
FIG. 7 is a graph representing variation of shunt current with respect to applied voltage having a train presence proximate the current shunt device of an isolated block section of a railway track along with an equivalent electrical circuit in accordance with an exemplary embodiment of the present invention.

FIG. 7 is a graph representing variation of shunt current with respect to applied voltage having a train presence proximate the current shunt device at the center of the isolated block section of the railway track. A schematic diagram of an exemplary electrical circuit is also shown. In accordance with the embodiments of the present invention, voltage (V) across the isolated block section of the railway track is determined in accordance with the following relation:

$$V \leq \frac{I_A(V_1(I_A R_s R_{train}+(R_s+R_{train})V_1)-I_1^2R_s^3)}{I_1^2R_s^2+I_A(I_A R_s R_{train}+(R_s+R_{train})V_1)} \quad (8)$$

Shunt current (I) is determined is determined in accordance with the relation:

$$I \leq \frac{I_1 I_A R_{train}(I_A R_s + V_1)}{I_1^2R_s^2+I_A(I_A R_{train}R_s+V_1(R_{train}+R_s)} \quad (9)$$

where $V_1$ is the voltage threshold value, $I_1$ is the no break/no train shunt current threshold value, $R_{train}$ is the train shunt resistance, Rs is the shunt device resistance, and $I_A$ is the current applied by the current source. In the illustrated example, when the train presence is detected proximate the shunt device located at the center of the isolated block section, the shunt current is reduced, but the applied remains constant.

Figure 8:
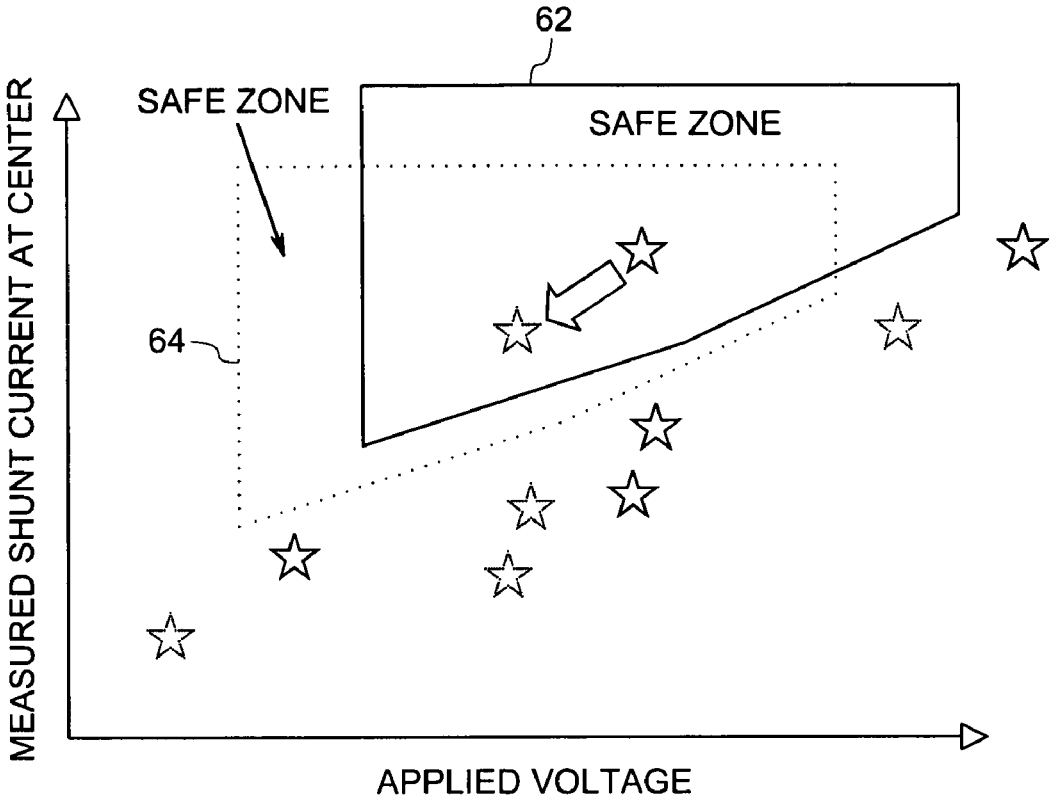
FIG. 8 is a graph representing variation of shunt current threshold value with respect to applied voltage threshold value in accordance with an exemplary embodiment of the present invention.

Referring now to FIG. 8, a graph representing variation of shunt current with respect to applied voltage is illustrated. In the illustrated example, the control unit 46 (FIG. 1) is configured to determine the "safe zone" 62 based on a rail vehicle shunt resistance value or a rail break resistance value. When the ballast resistance changes, for example due to change in environmental conditions, the control unit updates the shunt current threshold value and the voltage threshold value based on the ballast resistance value. An updated "safe zone" 64 is determined based on the updated shunt current threshold value and the voltage threshold value.

Figure 9:
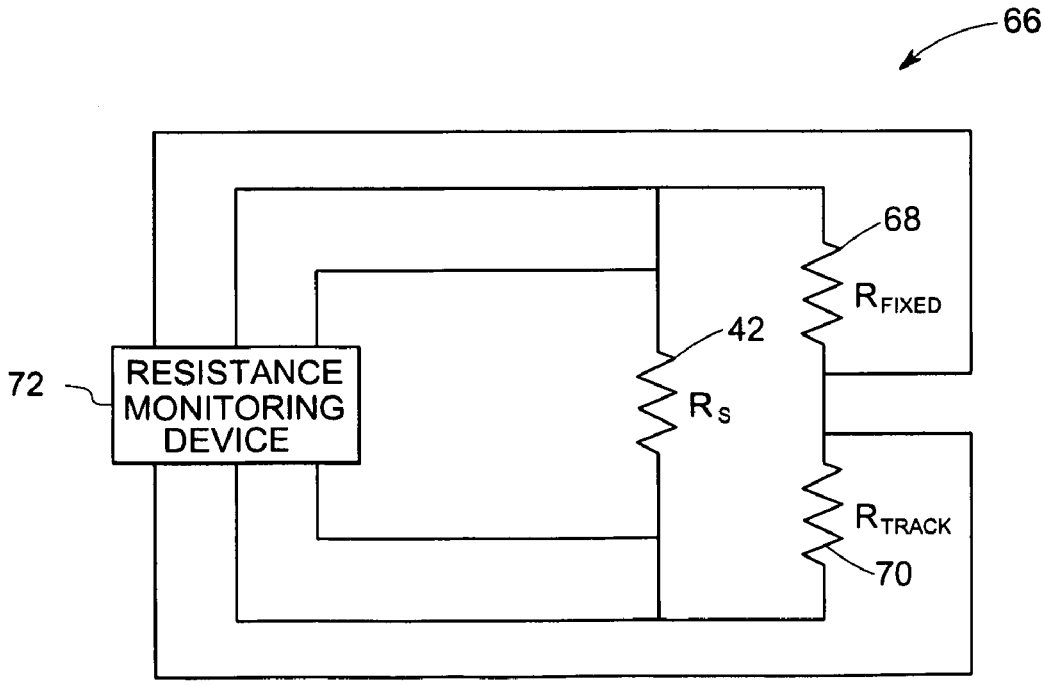
FIG. 9 is a schematic diagram of an electrical equivalent circuit of a 6-wire resistance measuring device in accordance with an exemplary embodiment of the present invention.

Referring to FIG. 9, a self-calibrating measuring device 66 is illustrated. In the illustrated example, the resistance measuring device 66 includes a 6-wire resistance measuring device configured to monitor the resistance of the shunt device i.e. shunt resistor ($R_s$). An electrical equivalent circuit of the 6-wire resistance measuring device 66 includes a fixed resistor 68, a track resistor 70, and the shunt resistor 42 (i.e. resistor under measurement) coupled in the form of a triangle. The fixed resistor 68, the track resistor 70, and the shunt resistor 42 are coupled to a resistance monitoring device 72. Measurement problems related to contamination may be overcome by forcing voltage at a midpoint between the fixed resistor 68 and the track resistor 70 to the same potential as that across the current source. The 6-wire resistance measuring device 66 comprises a unity-gain amplifier (op-amp) that maintains the voltage across inputs to approximately zero volts. The device 72 is used to monitor and calibrate the resistance of the shunt resistor 42 in such a way as known to those skilled in the art. As a result accuracy of measurement is enhanced. The self-calibrating measuring device may be incorporated within a tie of the rail track.

Figure 10:
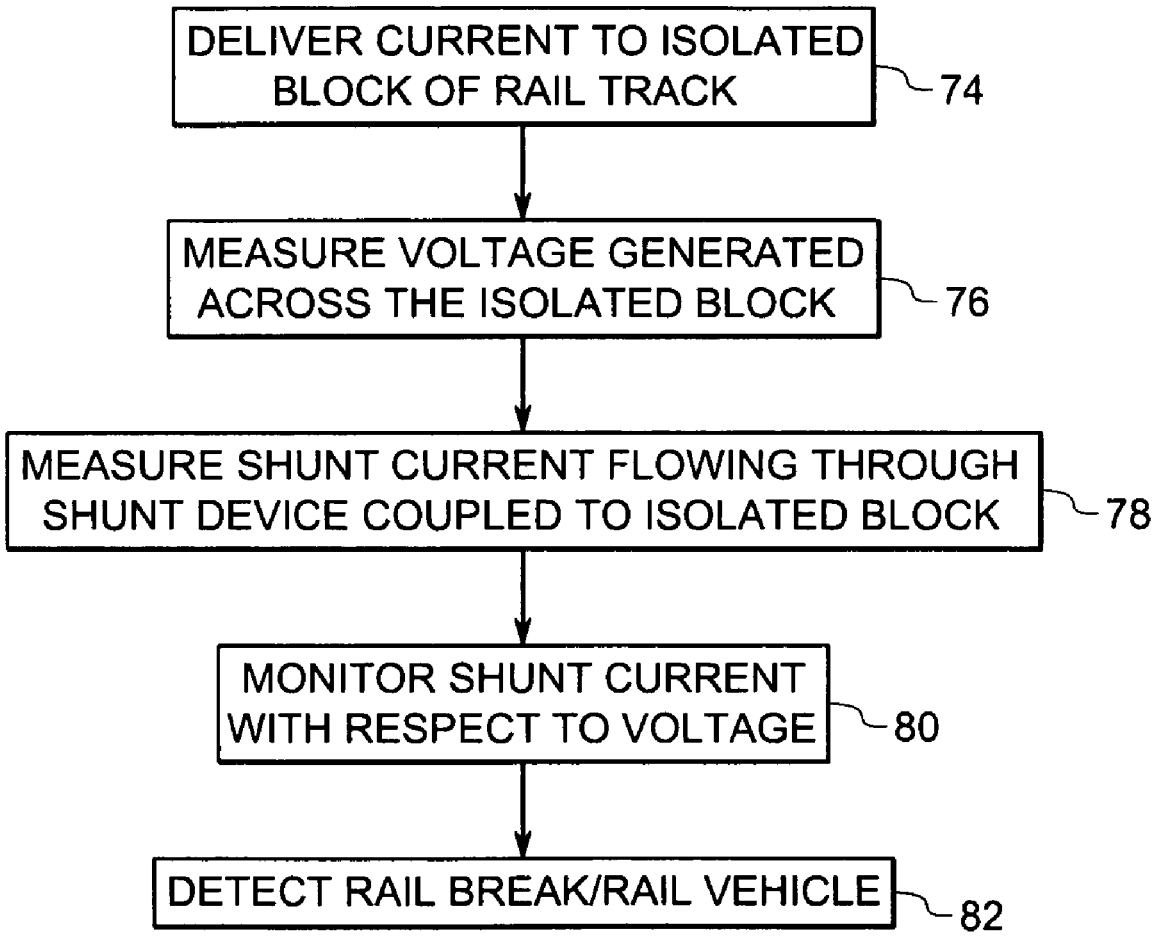
FIGS. 10 and 11 are flow charts illustrating exemplary processes of detecting rail break/vehicle in accordance with certain exemplary embodiments of the present invention.

FIG. 10 is a flow chart illustrating a method of detecting rail break/vehicle in accordance with an exemplary embodiment of the present invention. The method includes supplying current to the isolated block section 28 of the railway track 12 via the current sources 20, 22, as represented by step 74. The control unit 46 controls the current sources 20, 22 to deliver current pulses alternately from either end of the isolated block section 28 of the railway track 12. The polarity of the current sources 20, 22 may be switched to reverse current flow through the isolated block section 28 of the railway track 12. The measurements of the voltage sensors 34, 36 and the shunt current sensor 44 may be averaged to mitigate systematic and galvanic errors. The voltage generated across the rails 4, 16 is detected via the voltage sensors 34, 36 as represented by step 76. The shunt device 42 coupled to the isolated block section 28 of the railway track 12, receives a shunt current from the current delivered by the current source. In one example, the shunt device 42 is located mid way through the isolated block section 28 of the railway track 12. The shunt current flowing through the shunt device 42 is measured via the shunt current sensor 44 as represented by step 78.

The control unit 46 may receive input from the voltage sensors 34, 36 and the shunt current sensor 44 and monitor variation of the shunt current with respect to the voltage, as represented by step 80. The variation of shunt current with respect to the voltage is monitored to detect rail break or presence of a rail vehicle on the isolated block section 28 of the railway track 12 as represented by 82.

Figure 11:
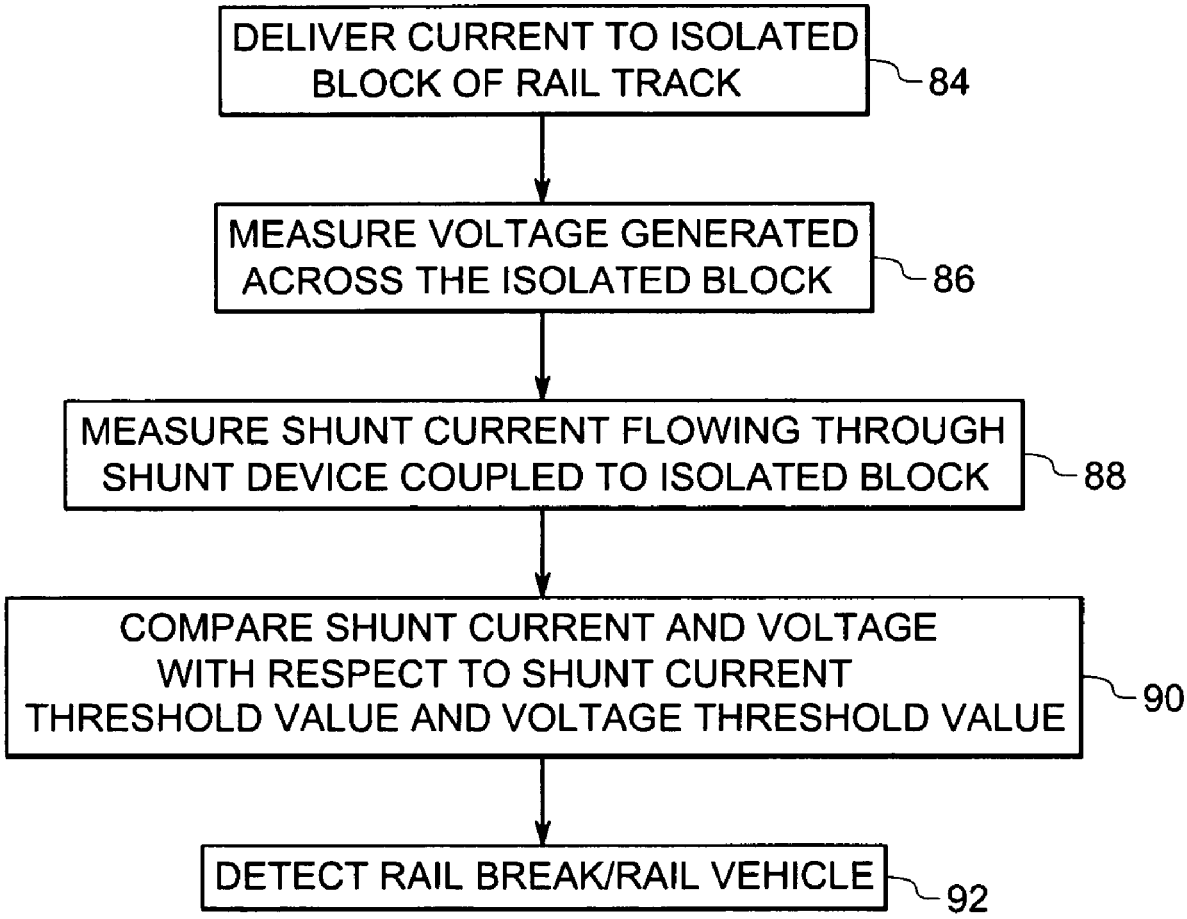

FIG. 11 is a flow chart showing another exemplary embodiment of a method of detecting rail break/vehicle in accordance with the present invention. The method includes supplying electric power to the isolated block section 28 of the railway track 12 via the current sources 20, 22, as represented by step 84. The control unit 46 controls the current sources 20, 22 to deliver current pulses alternately from either ends of the isolated block section 28 of the railway track 12. The voltage generated across the rails 14, 16 is detected via the voltage sensors 34, 36, as represented by step 86. The shunt device 42 coupled to the isolated block section 28 of the railway track 12 receives a shunt current from the current delivered by the current source. The shunt current flowing through the shunt device 42 is measured via the shunt current sensor 44, as represented by step 88. In the illustrated exemplary embodiment, a self-calibrating resistance measuring device is used to monitor and calibrate the resistance of the shunt device 42 over a period of time.

In the illustrated embodiment, the control unit 46 receives input from the voltage sensors 34, 36, and the shunt current sensor 44 and compares the shunt current and the voltage with respect to a shunt current threshold value and a voltage threshold value as represented by step 90. The comparison result is used to detect rail break or presence of a rail vehicle on the isolated block section 28 of the railway track 12, as represented by step 92. For example, if the variation of the shunt current and the voltage with respect to the shunt current threshold value and the voltage threshold value is greater than a predetermined threshold value, presence of a rail break/vehicle is indicated. The predetermined threshold value is determined as function of the shunt current threshold value and the voltage threshold value. The control unit 46 further updates the shunt current threshold value and the voltage threshold value based on a ballast resistance value, since the ballast resistance value varies due to changes in environmental conditions, such as humidity, precipitation, or the like. The above-mentioned techniques in accordance with the exemplary embodiments of the present invention facilitates decisioning between rail break and train presence over a wide variation of rail and ballast resistances.

While only certain features of the invention have been illustrated and described herein, many modifications and changes will occur to those skilled in the art. it is, therefore, to be understood that the appended claims are intended to cover all such modifications and changes as fall within the true spirit of the invention.

The invention claimed is:

1. A method for detecting a rail break in a rail track or a rail vehicle traveling on the rail track, comprising:

delivering a current to an isolated block of the rail track;

measuring a voltage generated across the isolated block of the rail track;

measuring a shunt current flowing through a shunt device coupled to the isolated block via a current sensor;

comparing a signal proportional to the shunt current and the voltage with respect to a shunt current threshold value and a voltage threshold value; and monitoring resistance of the shunt device via a self-calibrating resistance measuring device.

2. The method of claim 1, comprising monitoring resistance of the shunt device via a 6-wire resistance measuring device.

3. The method of claim 1, comprising delivering current alternately from a first end and a second end of the isolated block of the rail track.

4. The method of claim 1, further comprising monitoring a rate of change of the shunt current and the voltage with respect to the shunt current threshold value and the voltage threshold value.

5. The method of claim 4, further comprising determining rail vehicle speed based on the rate of change of the shunt current and the voltage with respect to the shunt current threshold value and the voltage threshold value.

6. The method of claim 5, further comprising determining a rail vehicle shunt resistance value and a rail break resistance value.

7. The method of claim 6, further comprising determining a safe zone based on the rail vehicle shunt resistance value and the rail break resistance value.

8. The method of claim 1, further comprising updating the shunt current threshold value and the voltage threshold value based on a ballast resistance value.

9. A system for detecting a rail break in a rail track or a rail vehicle traveling on the rail track, comprising:

at least one current source adapted to deliver a current to an isolated block of the rail track;

at least one voltage sensor coupled to the isolated block and configured to detect voltage across the isolated block;

a shunt device coupled to the isolated block and configured to receive a shunt current from the current delivered by the current source;

a shunt current sensor coupled to the shunt device and adapted to detect the shunt current flowing through the shunt device;

a control unit adapted to receive input from the voltage sensor and the shunt current sensor and to compare the shunt current and the voltage with respect to a shunt current threshold value and a voltage threshold value; and a self-calibrating resistance measuring device coupled to the shunt device and configured to monitor the resistance of the shunt device.

10. The method of claim 9, wherein the self-calibrating resistance measuring device comprises a 6-wire resistance measuring device configured to monitor the resistance of the shunt device.

11. The system of claim 9, wherein the control unit is adapted to monitor a rate of change of the shunt current and the voltage with respect to the shunt current threshold value and the voltage threshold value.

12. The system of claim 11, wherein the control unit is adapted to determine rail vehicle speed based on the rate of change of the shunt current and the voltage with respect to the shunt current threshold value and the voltage threshold value.

13. The system of claim 9, wherein the control unit is configured to determine a rail vehicle shunt resistance value and a rail break resistance value.

14. The system of claim 13, wherein the control unit is configured to determine a safe zone based on the rail vehicle shunt resistance value and the rail break resistance value.

15. The system of claim 9, wherein the control unit is configured to update the shunt current threshold value and the voltage threshold value based on a ballast resistance value.

* * * * *